US011407609B1

(12) United States Patent
Haag

(10) Patent No.: US 11,407,609 B1
(45) Date of Patent: Aug. 9, 2022

(54) WIRE SPOOL COVER

(71) Applicant: Robert Haag, North Bend, OR (US)

(72) Inventor: Robert Haag, North Bend, OR (US)

( * ) Notice: Subject to any disclaimer, the term of this patent is extended or adjusted under 35 U.S.C. 154(b) by 0 days.

(21) Appl. No.: 17/478,822

(22) Filed: Sep. 17, 2021

(51) Int. Cl.
*B65H 54/72* (2006.01)
*B65H 75/14* (2006.01)

(52) U.S. Cl.
CPC ..... *B65H 54/72* (2013.01); *B65H 75/141* (2013.01); *B65H 2701/36* (2013.01)

(58) Field of Classification Search
CPC .. B65H 75/141; B65H 54/72; B65H 2701/36; B65H 49/322; B65H 49/08; B65D 85/04
See application file for complete search history.

(56) References Cited

U.S. PATENT DOCUMENTS 1,905,488 A * 4/1933 Nack ..... B65H 75/141 206/399
2,519,312 A * 8/1950 Greenleaf ..... B65H 49/08 242/138
3,283,892 A 11/1966 Rosen
3,680,810 A * 8/1972 Jarmalow ..... B65D 85/676 242/171
3,698,546 A 10/1972 Kass
3,698,548 A * 10/1972 Stenzel ..... B65D 83/0882 242/588.4
4,010,914 A * 3/1977 Kowalski ..... B65H 49/322 242/129.62
5,053,795 A * 10/1991 Wyman ..... G03B 27/588 396/513
5,248,108 A * 9/1993 Zander ..... G03B 17/30 242/348.3

(Continued)

FOREIGN PATENT DOCUMENTS

CN 200530035771.6 4/2005
FR 2127123 A5 * 10/1972 ..... B21C 47/16

(Continued)

OTHER PUBLICATIONS

Genuine Bosch Art 23 26 30 Combitrim Easytrim Strimmer / Grass Trimmer Pro-Tap Automatic Spool Line + Cover (8m, F016L71088 + F016800175), www.OnBuy.com, at least as early as Jan. 5, 2021, Internet WWW, https://www.onbuy.com/GB/genuine-bosch-art-23-26-30-combitrim-easytrim-strimmer-grass-trimmer-pro-tap-automatic-spool-line-cover-8m-f016171088401680017 5~c11492~p7467178/.

(Continued)

*Primary Examiner* — Michael E Gallion
(74) *Attorney, Agent, or Firm* — Howard Russell, Attorney at Law

(57) ABSTRACT

Cover adapted for covering a spool of wire mounted on a shaft for preventing tangling of the wire during use, comprising a first cover portion comprising an outer wall and side walls, and a second cover portion comprising an outer wall and side walls adapted to attach to the shaft adjacent sides of the spool of wire without removing it from the shaft, the first and second cover portions being adapted for mating to cover the wire spool on the shaft, the second cover portion comprising an opening for allowing the wire on the spool to pass through the outer wall and allowing the spool of wire to rotate freely on the shaft to dispense the wire in a tangle-free manner from the spool as the wire is pulled through the opening.

16 Claims, 10 Drawing Sheets

(56) References Cited

U.S. PATENT DOCUMENTS

| | | | | | |
|---|---|---|---|---|---|
| 5,593,035 | A * | 1/1997 | Taylor | B65H 16/005 | 206/397 |
| 5,704,479 | A * | 1/1998 | Barnett | B65D 85/04 | 206/395 |
| 5,714,936 | A * | 2/1998 | Regelsberger | G03C 3/00 | 206/409 |
| 5,810,272 | A * | 9/1998 | Wallace | B65H 55/046 | 242/137.1 |
| 6,145,780 | A * | 11/2000 | Fontana | B65H 49/24 | 242/400 |
| 6,161,796 | A * | 12/2000 | Daniels | A47K 10/3836 | 242/597.1 |
| 6,491,163 | B1 * | 12/2002 | Grcic | B65D 85/676 | 206/403 |
| 7,252,262 | B2 | 8/2007 | Oku et al. | | |
| 7,500,635 | B2 * | 3/2009 | Cooper, Jr. | B65H 35/00 | 242/588.6 |
| 7,775,359 | B2 * | 8/2010 | Maeda | B65D 85/672 | 206/391 |
| 8,251,212 | B2 * | 8/2012 | Dunlap | B65D 85/04 | 206/403 |
| D712,749 | S | 4/2014 | Robertson | | |
| 9,908,737 | B2 * | 3/2018 | Chastain | B65H 75/185 | |
| 11,117,737 | B2 * | 9/2021 | Gonzalez | B65H 57/18 | |
| 2003/0089818 | A1 | 5/2003 | Reau et al. | | |
| 2006/0273218 | A1 * | 12/2006 | Oku | B65H 75/141 | 242/601 |
| 2007/0210131 | A1 | 9/2007 | Yarborough et al. | | |
| 2007/0295847 | A1 * | 12/2007 | Week | B65H 49/322 | 242/170 |
| 2011/0147249 | A1 * | 6/2011 | Huffman | B65D 5/0254 | 206/395 |
| 2012/0091249 | A1 * | 4/2012 | Crossett | B65D 85/04 | 242/580 |
| 2012/0318939 | A1 * | 12/2012 | Galgano | B65H 49/325 | 248/127 |

FOREIGN PATENT DOCUMENTS

| | | | | | |
|---|---|---|---|---|---|
| GB | 286859 | A * | 3/1928 | B65H 75/141 | |
| JP | 55061322 | A * | 5/1980 | B65H 54/72 | |
| JP | 3001174 | U | 8/1994 | | |
| JP | 2000294596 | A * | 10/2000 | B65H 75/141 | |
| JP | 2001002323 | A * | 1/2001 | B65H 75/141 | |
| PL | 004732840-0004 | | 12/2018 | | |
| WO | WO-9625349 | A1 * | 8/1996 | B65D 85/672 | |
| WO | WO-2007103400 | A2 * | 9/2007 | B65H 75/141 | |

OTHER PUBLICATIONS

ULTRADRY Spool Holders, www.thingiverse.com/thing:2352833, Jun. 12, 2017, Internet WWW, https://www.thingiverse.com/thing:2352833.

* cited by examiner

WIRE SPOOL COVER

FIELD OF THE INVENTION

The present invention relates to a device for use in covering a wire spool in order to prevent the wire from getting tangled as it is pulled off the spool, and in particular to an easy-to-use spool cover adapted for use with a wire spool while it is on a spool mounting shaft, or other spool caddy, to avoid tangling on the spool or the shaft and to avoid tangling with other spools of wire that may be arranged in close proximity on the shaft.

BACKGROUND OF INVENTION

The construction of buildings, residential or commercial, has included the distribution, placement, and mounting of a variety of wires, including, as examples, electrical wire, speaker wire, coaxial cables for television signals, network cabling, connection for security sensors, and HVAC sensors and controls. The wires have been commonly provided on metal or plastic spools with a circular opening adapted for mounting on a horizontal shaft where the spool can easily rotate in order to facilitate the dispensing of the wire as it is pulled from the spool.

The wiring has been installed by skilled workers who pull the wire from the spool as needed, often at longer distances from the spool. As wire has been pulled by the installer, the inertia of the rotating spool has released more wire than has been needed, causing excess wire to accumulate around an area of the spool where it has become tangled. When this has happened, the installer has been required to interrupt their work of installation and has had to return to the location of the spool to disentangle the wire, thus slowing the process of installation. This has especially been a problem when more than one wire spool is being used at the same time. For example, four spools of wire may be on the same spool caddy and be simultaneously pulled through one conduit.

Thus, to date, the installer has had to exercise a great deal of caution in the rate at which the wire has been pulled from the spool, or spools, in order to reduce the likelihood of entangling the wire, and this has also slowed down the process of pulling wire and has diverted the attention of the installer from the actual work of mounting and installation of the wire. Often, at least one additional worker has been needed to watch the wire to ensure the wires have not become entangled as the installer has pulled wire from the spool. Learning to keep the wire from tangling has been considered to be one of the more difficult skills for an apprentice to learn. Therefore, there has been needed a device that would be easy to use and would accomplish the containment of the spooled wire to avoid tangling, while also allowing the installer to pull wire as needed without slowing their work.

SUMMARY OF THE INVENTION

In accordance with an aspect and embodiment of the disclosure, there is provided a wire spool cover adapted for covering a spool of wire. The spool has opposing sides (also known as flanges) and a central hollow (also known as an arbor hole) tube (also known as a barrel) forming the spool and is adapted to be mounted on a shaft with the shaft passing through the central hollow tube. The wire spool cover is adapted for preventing tangling of the wire during use of the spool of wire on the shaft and comprises a first cover portion adapted to partially encompass a portion of the spool of wire. The first cover portion comprises an outer wall and at least one side wall. There is also provided a second cover portion adapted to partially encompass another portion of the spool of wire. The second cover portion comprises an outer wall and at least one side wall. The at least one side wall of the first cover portion and the at least one side wall of the second cover portion are each adapted to attach to the shaft adjacent an opposing side of the spool of wire without removing the spool of wire from the shaft.

The at least one side wall of the first cover portion preferably comprises a plurality of opposing side walls that are perpendicularly attached to the outer wall of the first cover portion. The at least one side wall of the second cover portion preferably also comprises a plurality of opposing side walls that are perpendicularly attached to the outer wall of the second cover portion.

Preferably, the first cover portion and the second cover portion are positionable to each partially encompass the spool of wire so at least one edge of the outer wall of the first cover portion and at least one edge of the outer wall of the second cover portion align. The at least one side wall of the first cover portion preferably comprises a particularly shaped mating portion that matingly fit with a complementarily shaped mating portion on the at least one side wall of the second cover portion such that the first cover portion and the second cover portion combine to form the spool cover around the spool of wire.

The at least one side wall of the first cover portion and the at least one side wall of the second cover portion may preferably be at least semi-circular in shape. However, other shapes known in the art may be used. The outer wall of the first cover portion and the outer wall of the second cover portion may preferably be each half cylindrical in shape, so when aligned and combined, the first cover portion and the second cover portion form the spool cover with a cylindrical shape. Other shapes known in the art may be used for the spool cover shape and the outer wall shapes.

The first cover portion and the second cover portion may comprise a plurality of cover portions adapted for enclosing the spool of wire mounted on the shaft without requiring clasps, hinges, pins or other hardware to connect the plurality of cover portions to each other.

The particularly shaped mating portion of the at least one side wall of the first cover portion may preferably be at least one particularly shaped protrusion and the complementarily shaped mating portion of the at least one side wall of the second cover portion may preferably be at least one complementarily shaped indentation. In such embodiment, the at least one particularly shaped protrusion matingly fits into the at least one complementarily shaped indentation when the first cover portion and the second cover portion are aligned such that the first cover portion and the second cover portion combine to form the spool cover. Thus, for example, if the particularly shaped mating portion of the at least one side wall of the first cover portion is a square protrusion, then the complementarily shaped mating portion of the at least one side wall of the second cover portion is a square indentation and the square protrusion would matingly fit into the square indentation. The particularly shaped mating portion and the complementarily shaped mating portion may be any shape known in the art, including a square or rectangle shape, triangular shape, circular or partially circular shape, or an elliptical or partially elliptical shape.

The at least one complementarily shaped indentation of the at least one side wall of the second cover portion may be formed by a complementarily shaped layer of material attached between a portion of the outer wall of the second cover portion and a portion of the side wall of the second cover portion. Thus, the at least one particularly shaped protrusion of the at least one side wall of the first cover portion may matingly fit between the portion of the outer wall of the second cover portion and the portion of the side wall of the second cover portion, and an edge of the at least one particularly shaped protrusion of the at least one side wall of the first cover portion may matingly align with the complementarily shaped layer of material when the at least one particularly shaped protrusion of the side wall of the first cover portion is pushed into the at least one complementarily shaped indentation of the at least one side wall of the second cover portion.

The second cover portion preferably further comprises an opening on the outer wall adapted for allowing the wire on the spool to pass through the outer wall of the second cover portion, allowing the spool of wire to rotate freely on the shaft while encompassed by the spool cover to dispense the wire in a tangle-free manner from the spool as it passes through the opening. The opening on the outer wall of the second cover portion may be an elongated capsule shape. Any other elongated shape known in the art may be used, such as a rectangle shape.

Further, preferably, the outer wall of the second cover portion may have a notch that can hold an end of a wire from the spool of wire when the spool of wire is not in use. Other means of holding an end of a wire known in the art may be used, such as a hole or a slit.

The at least one side wall of the first cover portion and the at least one side wall of the second cover portion are each adapted to be attached to the shaft preferably by means of a slit that is contiguous with an aperture in the center of the side wall. The aperture is of a diameter to accommodate the diameter of the shaft. The slit is narrower than the diameter of the aperture where the slit connects with the aperture and gets wider in width, or tapers, as the slit approaches an outer edge of the side wall to allow the shaft to fit through the slit and force fit into the aperture to hold the spool cover in place on the shaft. However, the slit does not need to taper as described and can be of same width throughout its length.

The at least one side wall of the second cover portion preferably at least partially overlaps with the at least one side wall of the first cover portion when combined to form the spool cover. In such embodiment, the at least one side wall of the second cover portion further comprises at least one depression and the at least one side wall of the first cover portion further comprises at least one ridge. The at least one ridge of the at least one side wall of the first cover portion matingly fits into the at least one depression of the at least one side wall of the second cover portion when aligned and overlapped to keep the first cover portion and the second cover portion together as the spool cover. Any shape known in the art may be used for the at least one depression and any shape known in the art may be used for the at least one ridge as long as the ridge fits through the depression and holds the side wall of the first cover portion and the side wall of the second cover portion together in aligned and at least partially overlapped position. For example, in an embodiment, the at least one depression of the at least one side wall of the second cover portion may be two holes and the at least one ridge of the at least one side wall of the first cover portion may be two bolt heads. Any number of depressions and ridges may be used.

Each of the at least one side wall of the first cover portion and each of the at least one side wall of the second cover portion preferably further comprises at least one handle. Each of the at least one handle of the at least one side wall of the first cover portion and the at least one side wall of the second cover portion may be comprised of an extended portion of the at least one side wall. Preferably, each of the at least one handle comprises at least one finger hole.

In accordance with one embodiment of this aspect of the disclosure, only one of the first cover portion and the second cover portion may be adapted to attach to the shaft.

It will be appreciated that the novel features of the foregoing aspects and embodiments address problems in the prior art, such as the tangling of wire as it is pulled from the spool, often when the installer is at some distance from the spool, requiring a pause in the installation process to return and untangle the wire. The process of mounting the wire spool cover is easy to implement and effective. The resulting cover allows the installer to focus on the work of installation, and this in turn provides for a faster and more efficient installation.

It will also be appreciated by those skilled in the art that there are various possible combinations of the above-described elements and sub-elements for various embodiments of the invention, whether such elements and sub-elements be combined in whole or in part, which may be employed without departing from the scope and spirit of the invention as claimed.

The subject matter of the present disclosure is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DETAILED DESCRIPTION

Figure 1:
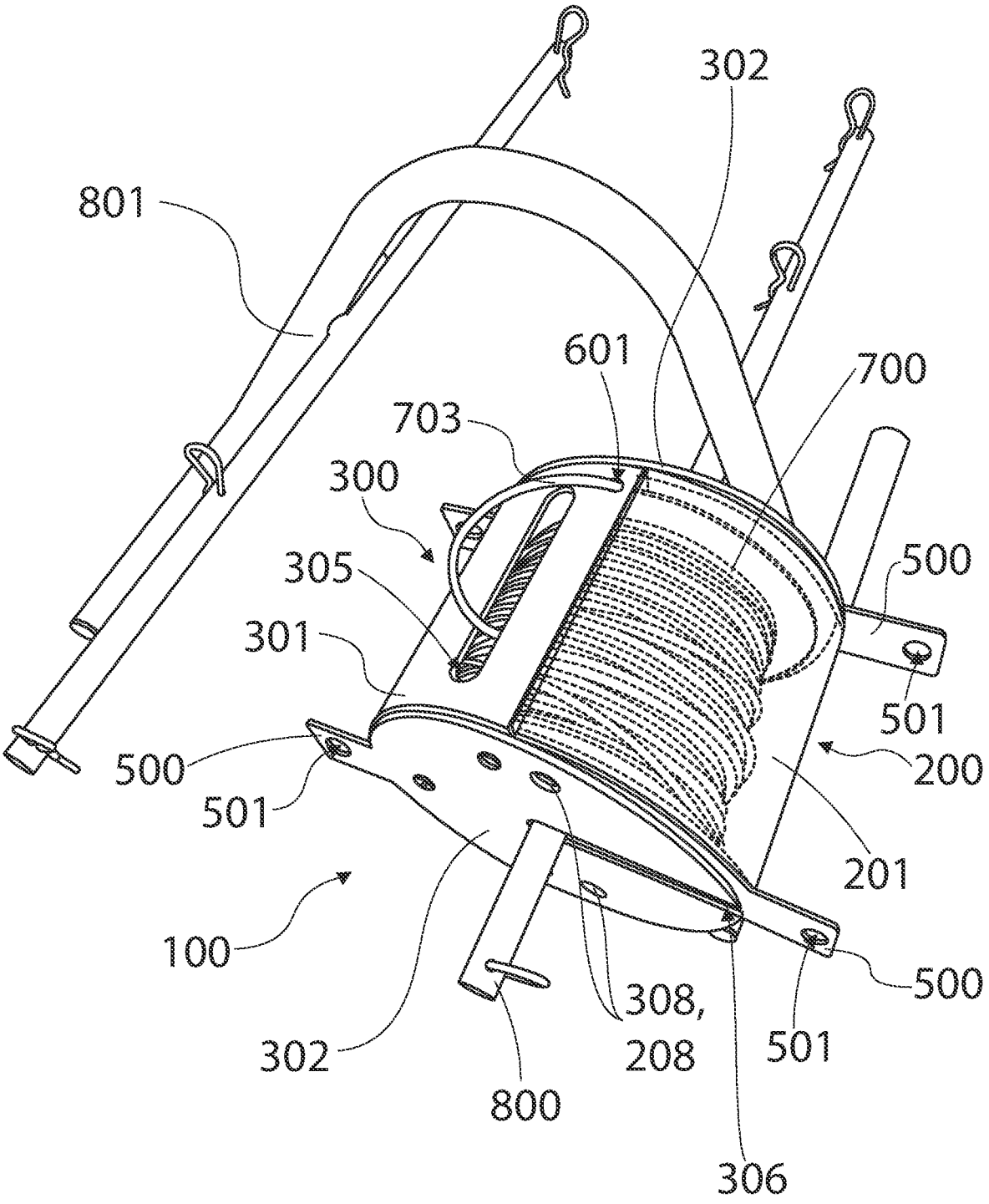
FIG. 1 is a top left perspective view of an embodiment of a spool cover on a shaft, with a first cover portion and a second cover portion, the first cover portion being see-through and with a spool of wire showing in dotted lines under the first cover portion.

Referring to FIGS. 1-10, and in accordance with one or more aspects of the disclosure, there are provided embodiments of a wire spool cover. For a first embodiment there is shown specifically in FIGS. 1-9 a wire spool cover 100 having two generally mating half cylindrical portions, a first cover portion 200 and a second cover portion 300, adapted for covering a wire spool 700 in order to prevent the wire 703 from getting tangled as it is rapidly pulled off the wire spool. The wire spool cover 100 is generally cylindrical in shape when the two half-cylindrical outer walls 201, 301 of the first and second cover portions 200, 300 are combined as the wire spool cover 100 is placed around a spool of wire 700, cord or other elongated material. Other shapes besides cylinder can be used for the wire spool cover 100 as long as it can encase the spool of wire 700 and allow the spool of wire 700 to spin freely within the exterior of the wire spool cover 100 as the wire 703 is pulled off the wire spool 700. The wire spool cover 100 is of a diameter large enough to encompass the wire spool 700 and fits relatively snugly enough to allow spinning of the wire spool 700. The wire spool cover 100 is preferably made of plastic, such as polyethylene terephthalate glycol (PETG), but other hard and durable materials known in the art may be used, such as wood or metal. The wire spool cover 100 may be see-through (as partially shown in FIG. 1) but does not need to be. Preferably, both the outer wall 201 of the first cover portion 200 and the outer wall 301 of the second cover portion 300 may be see-through as it may be desirable to allow viewing into the cover during use.

The wire spool cover 100 is adapted to cover wire 703 comprised of speaker wire, electrical wire, cable television type medium, etc., for between 14-gauge wire and up to 8-gauge wire that are 500 feet to 2500 feet long. However, wire spool cover size can be adjusted for smaller or larger gauge wires and to accommodate different lengths of wires.

FIG. 1 is a top left perspective view of the spool cover 100 on the shaft 800 of a wire spool caddy 801, with the first cover portion 200 and the second cover portion 300. The first cover portion 200 in depicted as being see-through with the spool of wire 700 showing in dotted lines under the first cover portion 200. As seen in FIG. 1, as a method of use, a wire spool 700 may be mounted on a metal shaft 800 that allows the wire spool 700 to rotate freely, such shaft 800 may be part of a single- or multiple-shaft wire spool caddy 801. The wire spool 700 generally has opposing sides (flanges) and a central hollow tube (a barrel with an arbor hole) forming the spool. The spool is adapted to be mounted on a shaft 800 with the shaft passing through the central hollow tube. The wire spool cover 100 is designed to encompass the wire spool 700 without hindering its rotation around the shaft 800 and adapted for preventing tangling of the wire 703 during use of the spool of wire 700 on the shaft 800. The wire spool cover 100 is comprised of the first cover portion 200 and the second cover portion 300, both adapted to partially encompass a portion of the spool of wire 700. The first cover portion 200 is comprised of an outer wall 201 and at least one side wall 202 (shown in FIGS. 2-9). The second cover portion 300 is comprised of the outer wall 301 and the at least one side wall 302.

FIG. 1 shows the first cover portion 200 and the second cover portion 300 are positionable to each partially encompass the spool of wire 700 so at least one edge 203 (shown in FIGS. 3-5) of the outer wall 201 of the first cover portion 200 and at least one edge 303 (shown in FIGS. 3, 7, 8) of the outer wall 301 of the second cover portion 300 align. The embodiment shown in FIGS. 1-9 have two edges 203 on the opposite side of the outer wall 201 of the first cover portion 200 that align with the two edges 303 on the opposite side of the outer wall 301 of the second cover portion 300. The edges 203, 303 are shown as preferably flat and straight so edges 203, 303 align parallel to each other. Other shapes that allow combining of the edges 203 of the first cover portion 200 with the edges 303 of the second cover portion 300 may be used. How the first cover portion 200 and the second cover portion 300 combine and hold together will be discussed in detail later.

The second cover portion 300 preferably has an opening 305 in the outer wall 301. The opening 305 allows free pulling/feeding of wire 703 through the opening 305. The opening 305 is adapted for allowing the wire 703 on the spool 700 to pass through the outer wall 301 of the second cover portion 300, which allows the spool of wire 700 to rotate freely on the shaft 800 while encompassed by the spool cover 100 to dispense the wire 703 in a tangle-free manner from the spool 700 as the wire 703 is pulled and passed through the opening 305. The opening 305 is elongated capsule shaped for this embodiment, but other elongated shapes known in the art, such as a rectangle, may be used. The edges of the opening 305 functions to create a surface on which the wire 703 drags against as it is pulled through the opening 305, causing friction that slows down the speed of wire 703 as the wire is dispensed from the spool 700, thereby preventing the tangling of the wire as it is pulled out. The opening 305 is preferably about 0.5 inches away from one of the edges 303 (shown in FIGS. 3 and 8) of the outer wall 301 of the second cover portion 300 that aligns with one of the edges 203 (shown in FIGS. 3-5) of the outer wall 201 of the first cover portion 200. However, the opening 305 may be placed in different distance from the one of the edges 303 (shown in FIGS. 3, 7, 8) of the outer wall 301 of the second cover portion 300. The opening 305 may also be placed on the outer wall 201 of the first cover portion 200 instead without changing its function.

The outer wall 301 of the second cover portion 300 preferably also has a notch 601, shown as a hole 601 with an end of the wire 703 inserted in FIG. 1. The notch 601 holds an end of a wire 703 from the spool of wire 700 when the spool of wire 700 is not in use, to prevent tangling of the wire 700 end and facilitate organized storage of the spool of wire 700. Even when the spool of wire 700 is not mounted on the shaft 800, the spool cover 100 can be placed around the spool of wire 700 and the end of the wire 703 can be pulled through the opening 305 and into the notch 601 for easy storage. The opening of the notch 601 may be of a diameter big enough to hold a wire end for between 14-gauge wire and up to 8-gauge wire. Typically, this would be a diameter big enough to handle between 0.0641 inches and up to 0.1285 inches.

In this embodiment, the at least one side wall 202 of the first cover portion 200 is two side walls 202 and, the at least one side wall 302 of the second cover portion 300 is two side walls 302. The side walls 202 of the first cover portion 200 and the side walls 302 of the second cover portion 300 are each adapted to attach to the shaft 800 adjacent an opposing side of the spool of wire 700 without removing the spool of wire 700 from the shaft 800.

In FIG. 1, the side walls 202 (not shown in FIG. 1) of the first cover portion 200 are two at least semi-circular shaped side walls perpendicularly attached to the opposing sides of the outer wall 201 of the first cover portion 200. The side walls 302 of the second cover portion 300 are two at least semi-circular shaped side walls perpendicularly attached to the opposing sides of the outer wall 301 of the second cover portion 300. As seen in FIG. 1, each of the side walls 202, 302 attach to the shaft 800 by means of a slit 206, 306 (206 not shown in FIG. 1). The slits 206, 306 will be discussed in detail later.

In an embodiment, the at least one side wall 302 of the second cover portion 300 preferably at least partially overlaps with the at least one side wall 202 of the first cover portion 200 when combined to form the spool cover 100. In the embodiments shown in FIGS. 1-9, the two side walls 302 of the second cover portion 300 overlaps the two side walls 202 of the first cover portion 200 when combined to form the wire spool cover 100. The spool cover 100 can be designed so the side walls 202 of the first cover portion 200 overlap the side walls 302 of the second cover portion 300 instead. The at least one side wall 302 of the second cover portion 300 preferably have at least one depression 308 and the at least one side wall 202 of the first cover portion 200 preferably have at least one ridge 208. The overlapped side walls 202, 302 can be assisted in being combined by inserting the at least one ridge 208 into the at least one depression 308. As can be seen in FIGS. 1-9, the at least one depression 308 may be two holes 308 and the at least one ridge 208 may be two bolt heads or two screw heads 208 that matingly fit partially within the two holes 308 when the first cover portion 200 and the second cover portion 300 are aligned and overlapped.

The at least one side wall 202 of the first cover portion 200 and the at least one side wall 302 of the second cover portion 300 may preferably have at least one handle 500. The at least one handle 500 is preferably comprised of an extended portion of the at least one side wall 202, 302. However, other means of attaching or having a handle known in the art may be used. The at least one handle 500 may preferably have at least one finger hole 501. As shown in FIGS. 1-9, the at least one handle 500 may be one handle 500 with one finger hole 501 made of extended portion of the side wall 202, 302.

Figure 2:
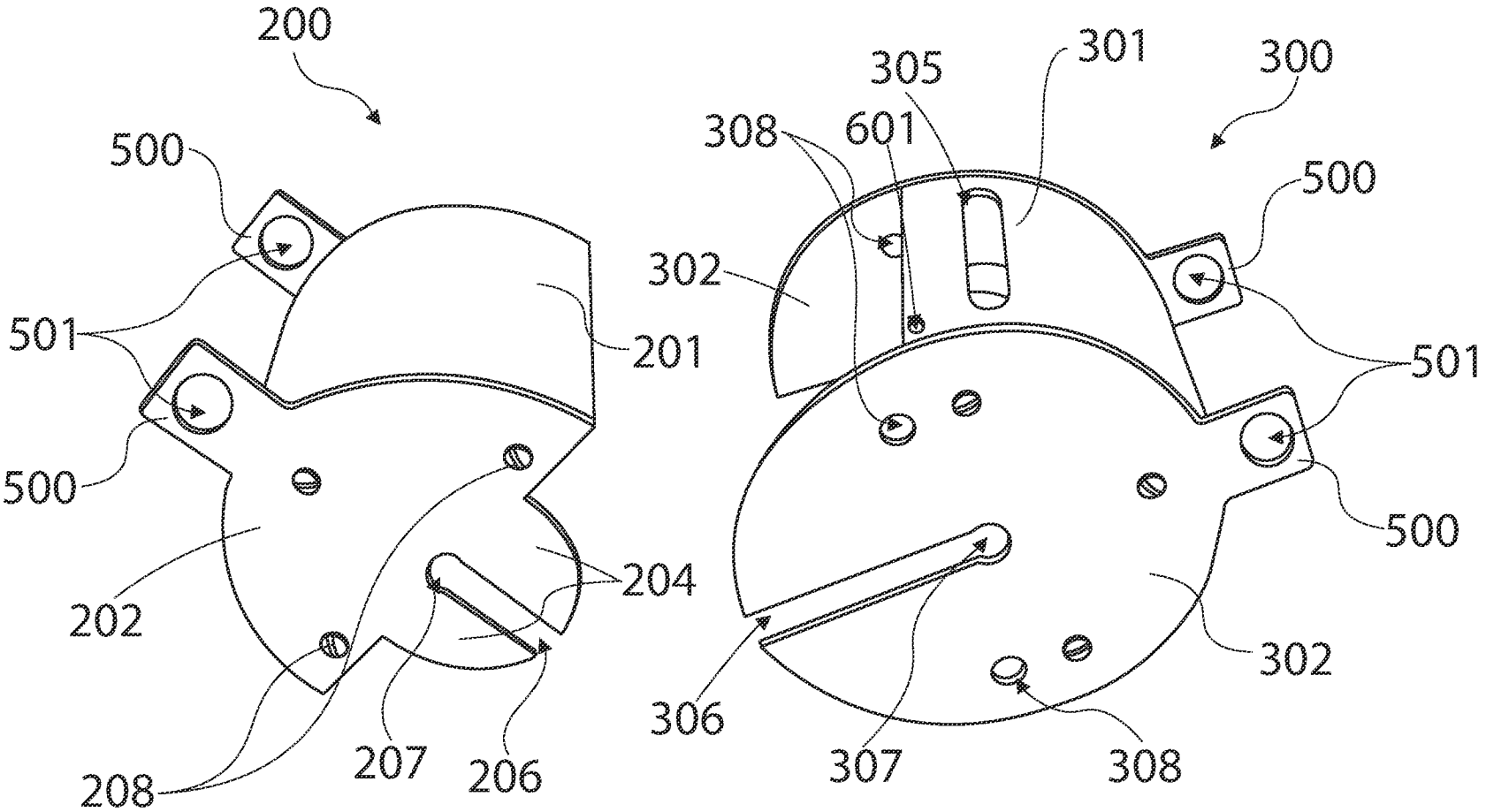
FIG. 2 is a side perspective view of the first cover portion and the second cover portion of the spool cover next to each other.
Figure 4:
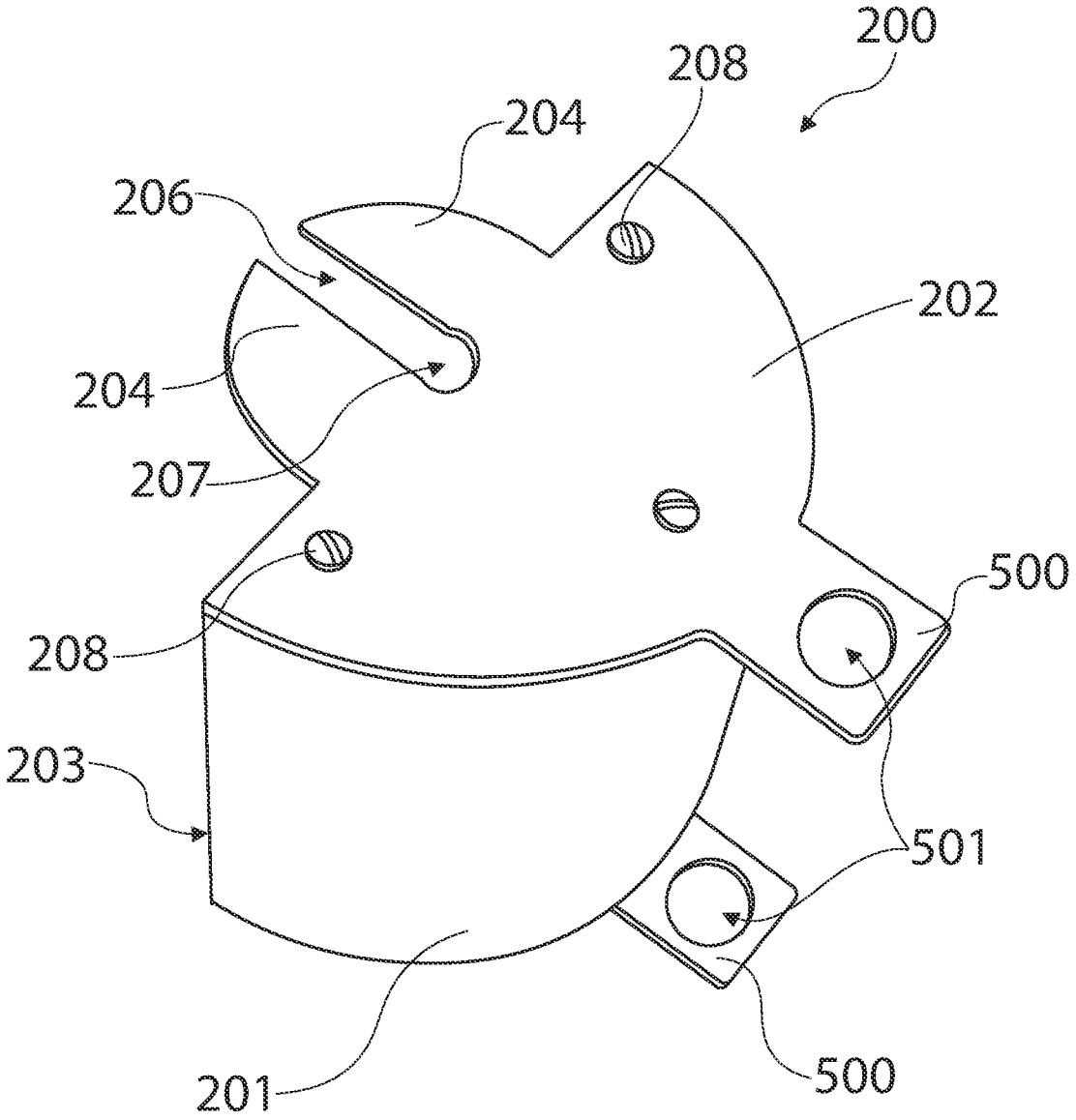
FIG. 4 is a close-up external perspective view of the first cover portion from FIG. 2.
Figure 7:
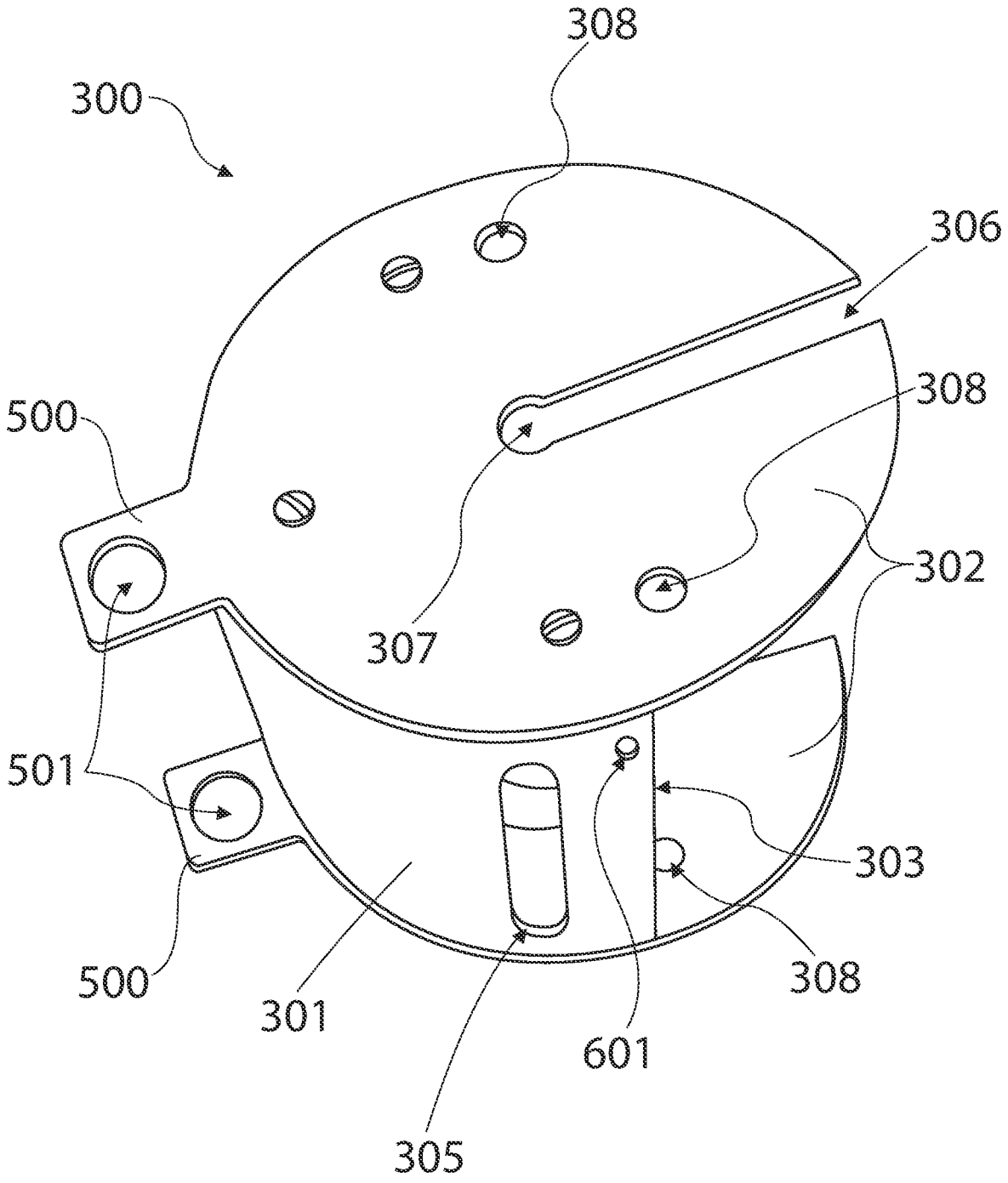
FIG. 7 is a close-up external perspective side view of the second cover portion from FIG. 2.

FIG. 2 is a side perspective view of the first cover portion 200 and the second cover portion 300 of the spool cover 100 next to each other. FIG. 4 is a close-up external perspective view of the first cover portion 200 from FIG. 2. FIG. 7 is a close-up external perspective side view of the second cover portion 300 from FIG. 2. The second cover portion 300 has the curved outer wall 301 that is half cylindrical, the opening 305, and the notch 601. Two side walls 302 of the second cover portion 300 are each perpendicularly attached to the outer wall 301 by three screws. These screws allow for replacement of the side walls and for accommodating different size spools with different sized side walls. The two side walls 302 each have an extended portion forming a handle 500 with a finger hole 501. The two side walls 302 each further has two holes 308 for depression 308. Each side wall 302 of the second cover portion 300 has the slit 306 and an aperture 307, which allows the side wall 302 to attach onto the shaft 800 (shown in FIG. 1) without removing the spool of wire 700 (shown in FIG. 1). The slit 306 is contiguous with the aperture 307. The aperture 307 is in the center of the shape of the side wall 302 and is of a diameter to accommodate the diameter of shaft 800. The slit 306 is narrower than the diameter of the aperture 307 where the slit 306 connects with the aperture 307 and gets wider in width, or tapers, as the slit 306 approaches an outer edge of the side wall 302. The narrower diameter of the slit 306 where the slit 306 connects with the aperture 307 allows the shaft 800 to force fit into the aperture 307 to hold the spool cover 100 in place on the shaft 800 while the wider portions of the slit 306 allows the shaft 800 to fit through the slit 306 easily.

The first cover portion 200 has a curved outer wall 201 that is half cylindrical. Two side walls 202 are each attached perpendicularly to the curved outer wall 201 by three screws. Two of the screws 208 are used as the ridges 208 to connect with the holes 308 of the side walls 302 of the second cover portion 300 when aligned and overlapped, as seen in FIG. 1, to assist in holding the combined first cover portion 200 and the second cover portion 300 together into the wire spool cover 100. The two side walls 202 of the first cover portion 200 each have an extended portion forming a handle 500 with a finger hole 501. Each side wall 202 of the first cover portion 200 has the slit 206 and an aperture 207, which allows the side wall 202 to attach onto the shaft 800 (shown in FIG. 1) without removing the spool of wire 700 (shown in FIG. 1). The slit 206 is contiguous with the aperture 207. The aperture 207 is in the center of the shape of the side wall 202 and is of a diameter to accommodate the diameter of shaft 800. The slit 206 is narrower than the diameter of the aperture 207 where the slit 206 connects with the aperture 207 and gets wider in width, or tapers, as the slit 206 approaches an outer edge of the side wall 202. The narrower diameter of the slit 206 where the slit 206 connects with the aperture 207 allows the shaft 800 to force fit into the aperture 207 to hold the spool cover 100 in place on the shaft 800 while the wider portions of the slit 206 allows the shaft 800 to fit through the slit 206 easily. While the slits 206, 306 preferably have tapering shape in this embodiment, the slits 206, 306 do not need to taper and can be of same width throughout and other means of holding the shaft 800 in the aperture 207, 307 known in the art may be used. FIG. 2 also shows the particularly shaped mating portion 204 of the side wall 202 of the first cover portion 200, which will be described in detail below.

Figure 3:
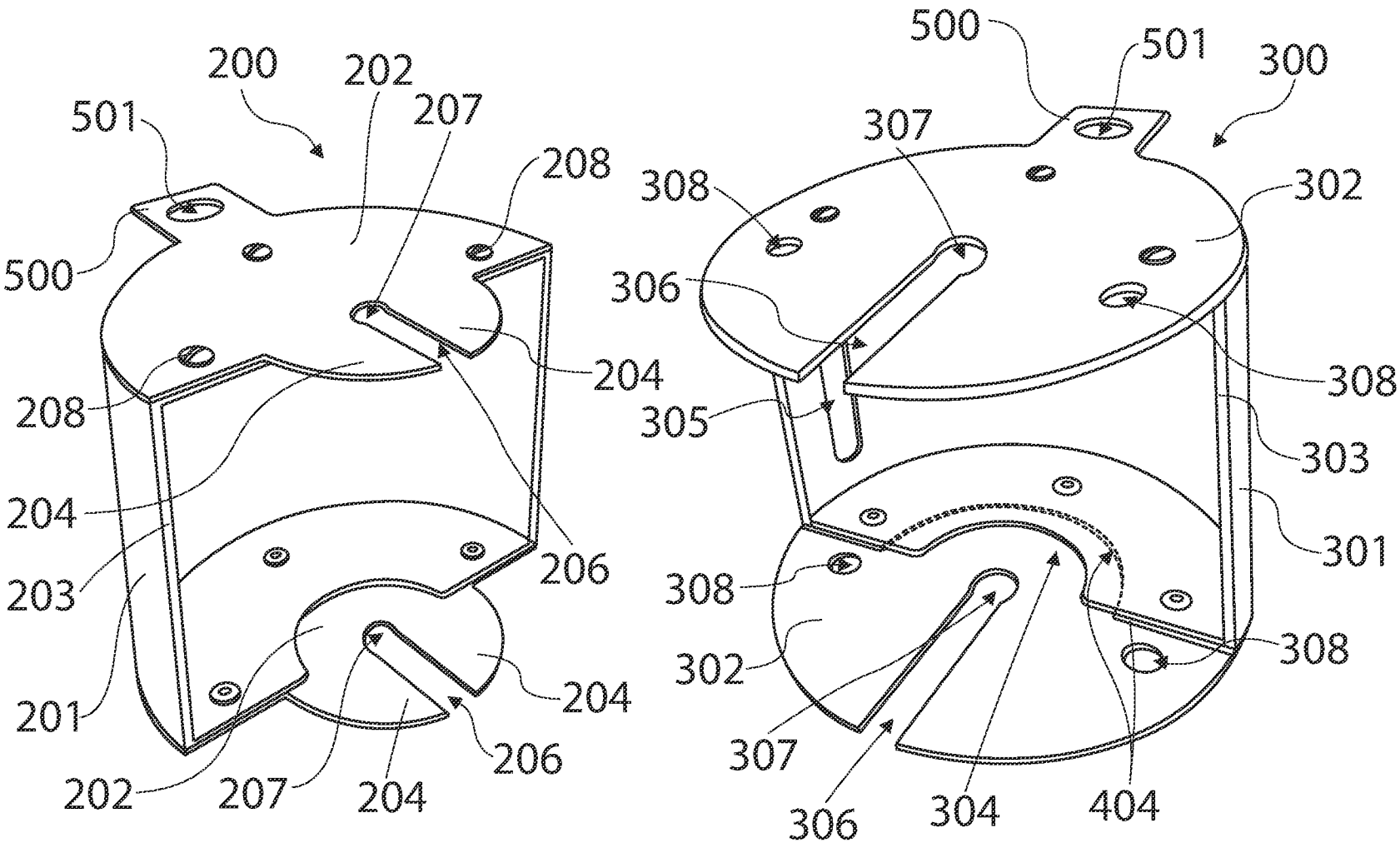
FIG. 3 is bottom perspective views of the first cover portion and the second cover portion of the spool cover, wherein a complementarily shaped layer of material of a complementarily shaped indentation in each of the side walls of the second cover portion, adapted for receiving particularly shaped protrusions of each of the side walls of the first cover portion, is shown with dashed lines.
Figure 5:
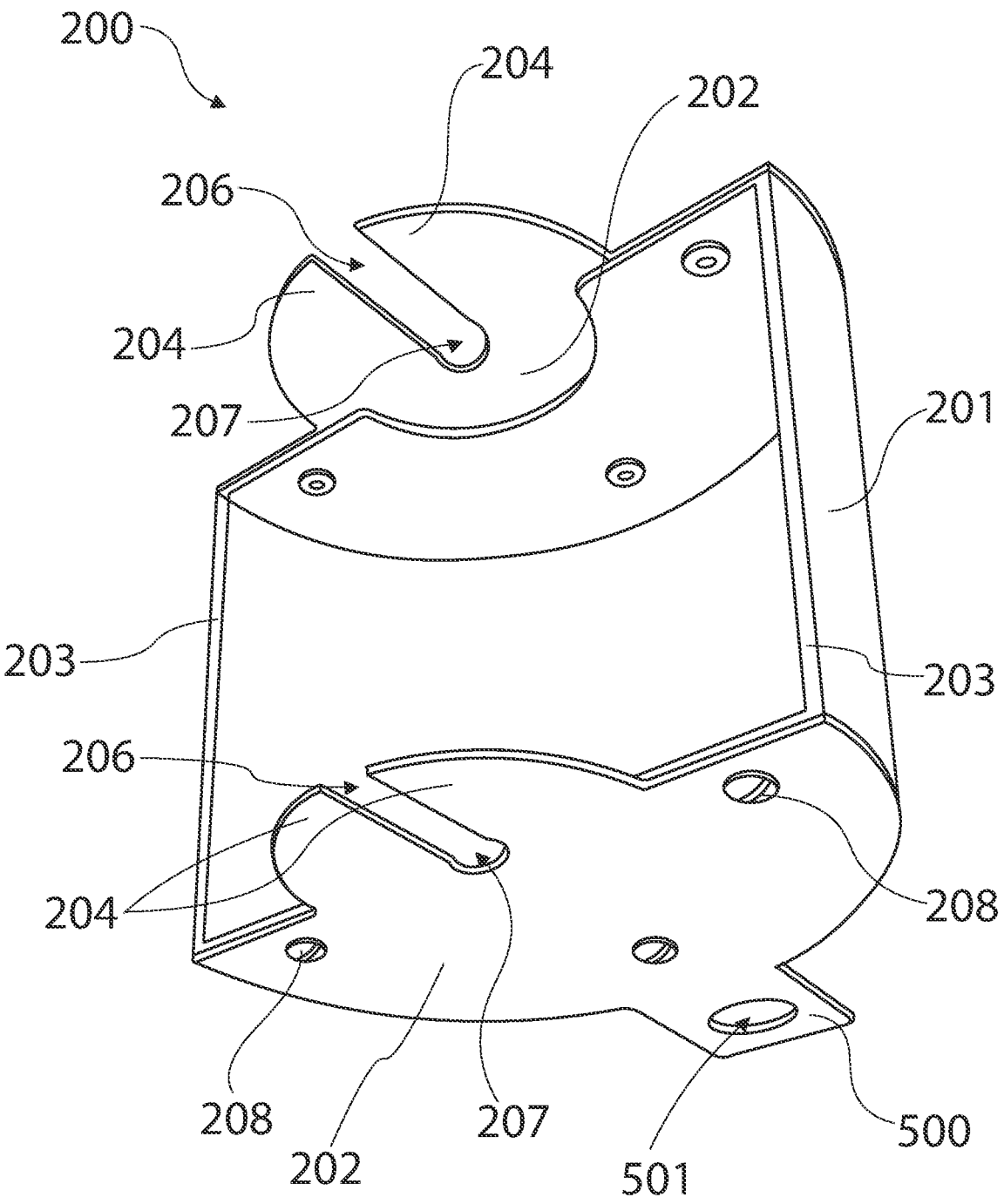
FIG. 5 is a close-up internal perspective view of the first cover portion from FIG. 3.
Figure 8:
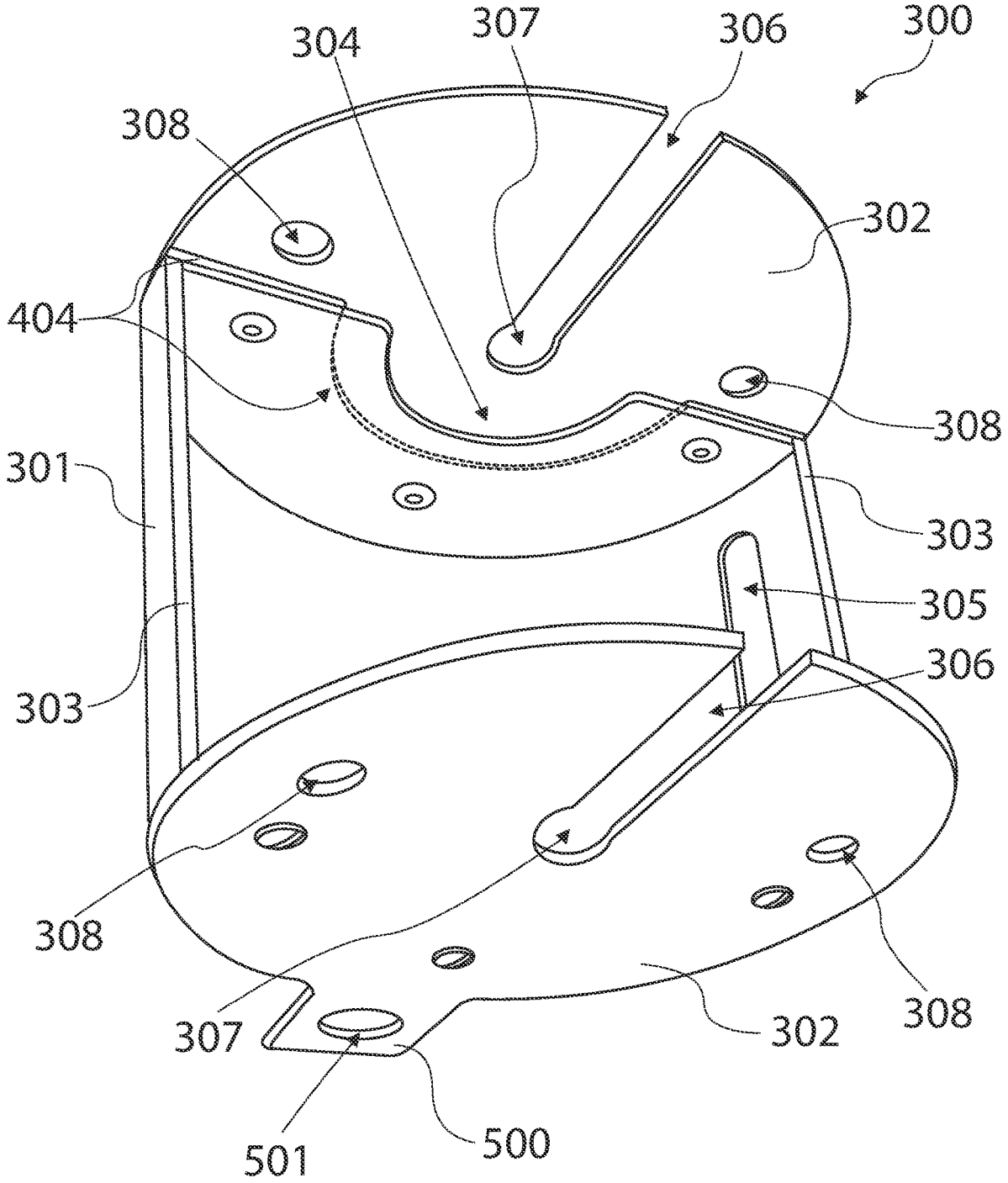
FIG. 8 is a close up internal perspective side view of the second cover portion from FIG. 3.

FIG. 3 is bottom perspective views of the first cover portion 200 and the second cover portion 300 of the spool cover 100. FIG. 5 is a close-up internal perspective view of the first cover portion 200 from FIG. 3. FIG. 8 is a close up internal perspective side view of the second cover portion 300 from FIG. 3. Dashed line is used to show an edge of a complementarily shaped layer of material 404 of the complementarily shaped indentation 304, optionally sandwiched between a portion of the outer wall 301 and a portion of the side wall 302 of the second cover portion 300. In an embodiment and in accordance with an aspect of the disclosure, the at least one side wall 202 of the first cover portion 200 may preferably comprise a particularly shaped mating portion 204 that matingly fit with a complementarily shaped mating portion 304 on the at least one side wall 302 of the second cover portion 300. The first cover portion 200 and the second cover portion 300 are held together by mating of the particularly shaped mating portion 204 and the complementarily shaped mating portion 304 when aligned and combined to form the wire spool cover 100.

The particularly shaped mating portion 204 of the at least one side wall 202 of the first cover portion 200 may preferably be at least one particularly shaped protrusion 204. The complementarily shaped mating portion 304 of the at least one side wall 302 of the second cover portion 300 may preferably be at least one complementarily shaped indentation 304. The at least one particularly shaped protrusion 204 matingly fits into the at least one complementarily shaped indentation 304 when the first cover portion 200 and the second cover portion 300 are aligned such that the first cover portion 200 and the second cover portion 300 combine to form the spool cover 100.

The at least one complementarily shaped indentation 304 may be formed by the complementarily shaped layer of material 404 attached between the portion of the outer wall 301 of the second cover portion 300 and the portion of the side wall 302 of the second cover portion 300 such that the at least one particularly shaped protrusion 204 of the at least one side wall 202 of the first cover portion 200 fits between the portion of the outer wall 301 of the second cover portion 300 and the portion of the side wall 302 of the second cover portion 300. An edge of the at least one particularly shaped protrusion 204 of the at least one side wall 202 of the first cover portion 200 matingly aligns with the edge of the complementarily shaped layer of material when the at least one particularly shaped protrusion 204 of the side wall 202 of the first cover portion 200 is pushed into the at least one complementarily shaped indentation 304 of the at least one side wall 302 of the second cover portion 300. Thus, the first cover portion 200 and the second cover portion 300 combine to form the wire spool cover 100. Other means of holding the first cover portion 200 and the second cover portion 300 together may be used.

FIGS. 2-6 depict two particularly shaped protrusions 204, each half-semi-circle shaped, together forming a semi-circle shape with the slit 206 separating the two particularly shaped protrusions 204. When the first cover portion 200 and the second cover portion 300 are aligned and combined, the two particularly shaped protrusions 204 slide and matingly fit into the semi-circle shaped complementarily shaped indentation 304, shown in FIGS. 3 and 8, formed by the edge of the complementarily shaped layer of material 404 between the portion of the outer wall 301 of the second cover portion 300 and the portion of the side wall 302 of the second cover portion 300. The dashed line outlines the edge of the complementarily shaped layer of material 404.

Figure 6:
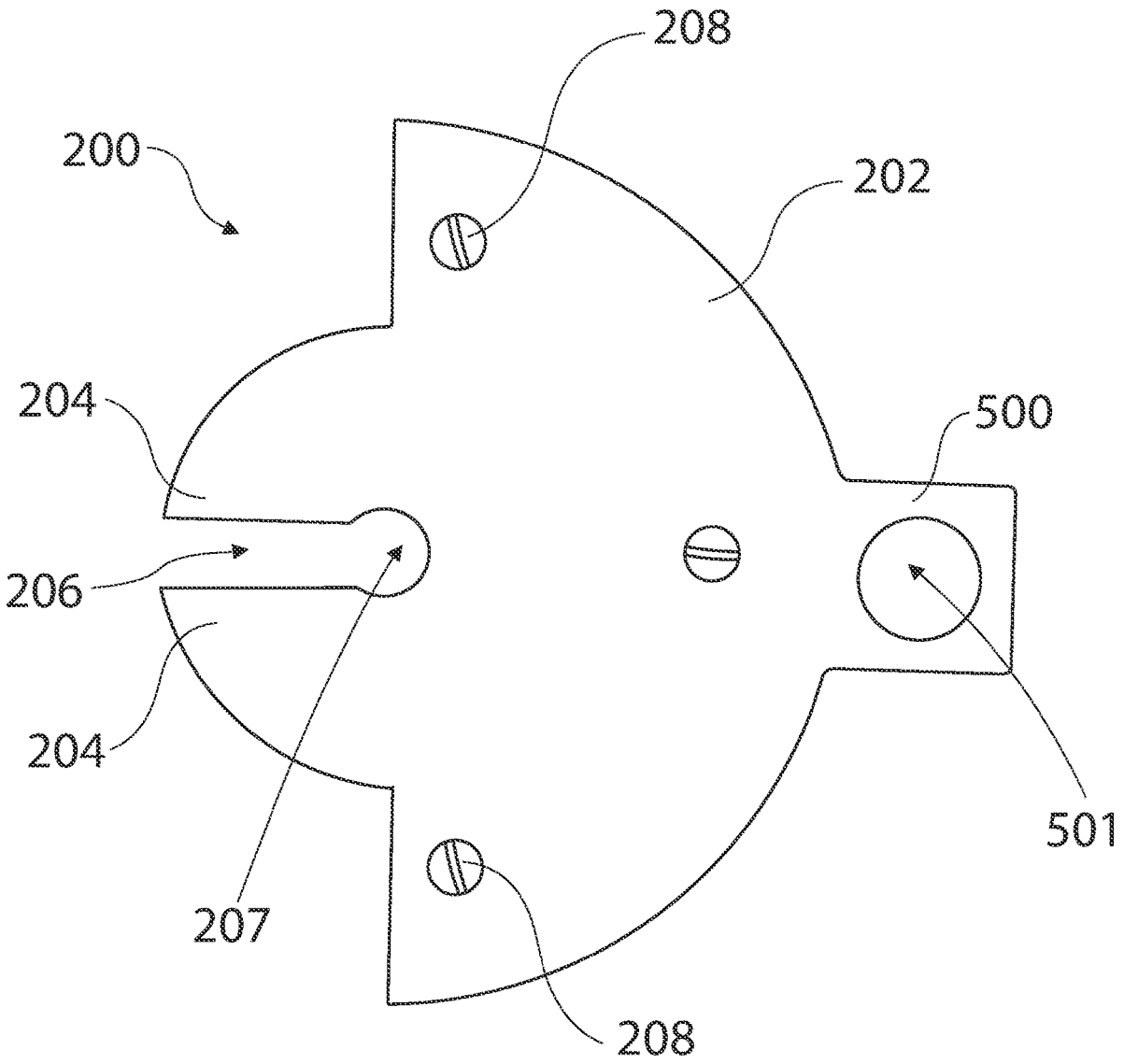
FIG. 6 is a side view of the first cover portion showing the side wall.

FIG. 6 is a side view of the first cover portion 200 showing one of the two side walls 202. The side wall 202 has a shape of a larger semi-circle with a square handle 500 with the finger hole 501 attached to its outer edge. The larger semi-circle portion of the side wall 202 is connected to a smaller semi-circle portion formed by the two particularly shaped protrusions 204, which are each half-semi-circle in shape. The slit 206 separates the two particularly shaped protrusions 204 from each other. The slit 206 is of width to allow shaft 800 (shown in FIG. 1) to slide through and into the aperture 207. The width of slit 206 is smaller than the diameter of the aperture 207 to allow for forced fitting of the shaft 800, which prevents rotation of the wire spool cover 100. The slit 206 may be tapered so it is larger in width towards the edge of the smaller semi-circle but does not need to be. The aperture 207 is placed in the center of the side wall 202, where the smaller semi-circle portion and the larger semi-circle portion merge. The aperture 207 is designed to line up with the spindle of the spool of wire 700 (shown in FIG. 1). Usually for 8 to 14-guage wires, the spindle of the spool 700 is between 1 inch to 1.125 inches in diameter. The diameter of the shaft 800 is usually between 0.25 inches to 0.75 inches, and the aperture 207 size should be between 0.25 inches to 0.75 inches to accommodate the diameter of the shaft 800. The side wall 202 is attached to the outer wall 201 (not shown in FIG. 6) by three screws. Screws are preferred as they allow for easy removal and attachment of side wall 202, which allows for switching out side walls 202 with different aperture 207 sizes to accommodate for differing shaft 800 sizes. Two of the screws 208 also act as the ridges 208 that combine with the depression or the hole 308 (not shown in FIG. 6) of the side wall 302 of the second cover portion 300. More than three screws may be used, and other means of attachment known in the art may be used. Other means and shapes of ridges may also be used.

Figure 9:
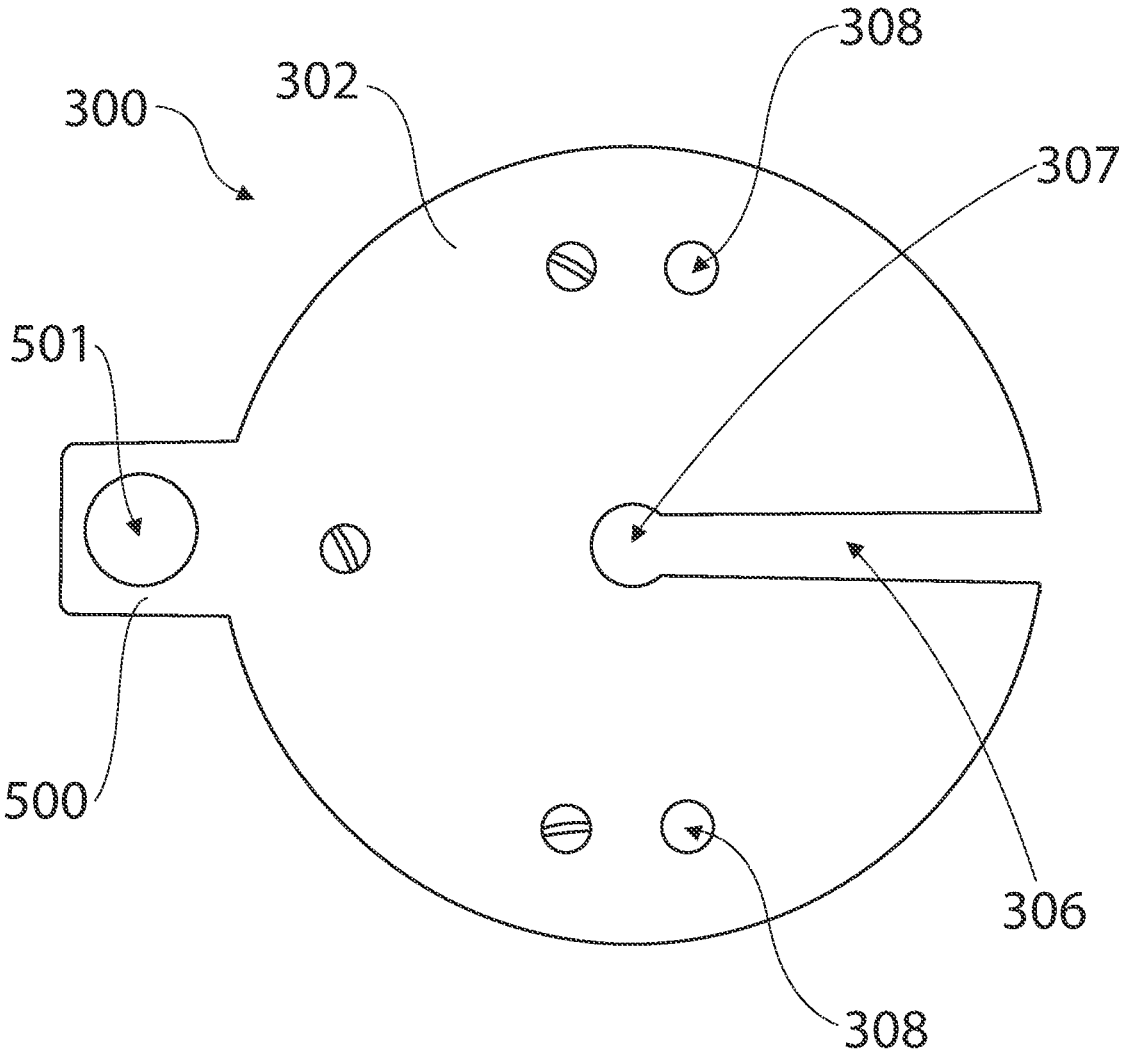
FIG. 9 is a side view of the second cover portion showing the side wall.

FIG. 9 is a side view of the second cover portion 300 showing one of the two side walls 302. The side wall 302 has a shape of a circle with a square handle 500 with the finger hole 501 attached to its outer edge. The slit 306 has a length of the radius of the circle shape. The slit 306 is of width to allow shaft 800 (shown in FIG. 1) to slide through and into the aperture 307. The width of slit 306 is smaller than the diameter of the aperture 307 to allow for forced fitting of the shaft 800, which prevents rotation of the wire spool cover 100. The slit 306 may be tapered so it is larger in width towards the edge of the side wall 302 but does not need to be. The aperture 307 is placed in the center of the side wall 302. The aperture 307 is designed to line up with the spindle of the spool of wire 700 (shown in FIG. 1). The side wall 302 is attached to the outer wall 301 (not shown in FIG. 9) by three screws. Screws are preferred as they allow for easy removal and attachment of side wall 302, which allows for switching out side walls 302 with different aperture 307 sizes to accommodate for differing shaft 800 sizes. There are two holes 308, or depressions 308, designed to receive and hold the ridges 208 (not shown in FIG. 9) of the side wall 202 of the first cover portion 200. More than three screws may be used, and other means of attachment known in the art may be used. Other means and shapes of depression may be used.

Figure 10:
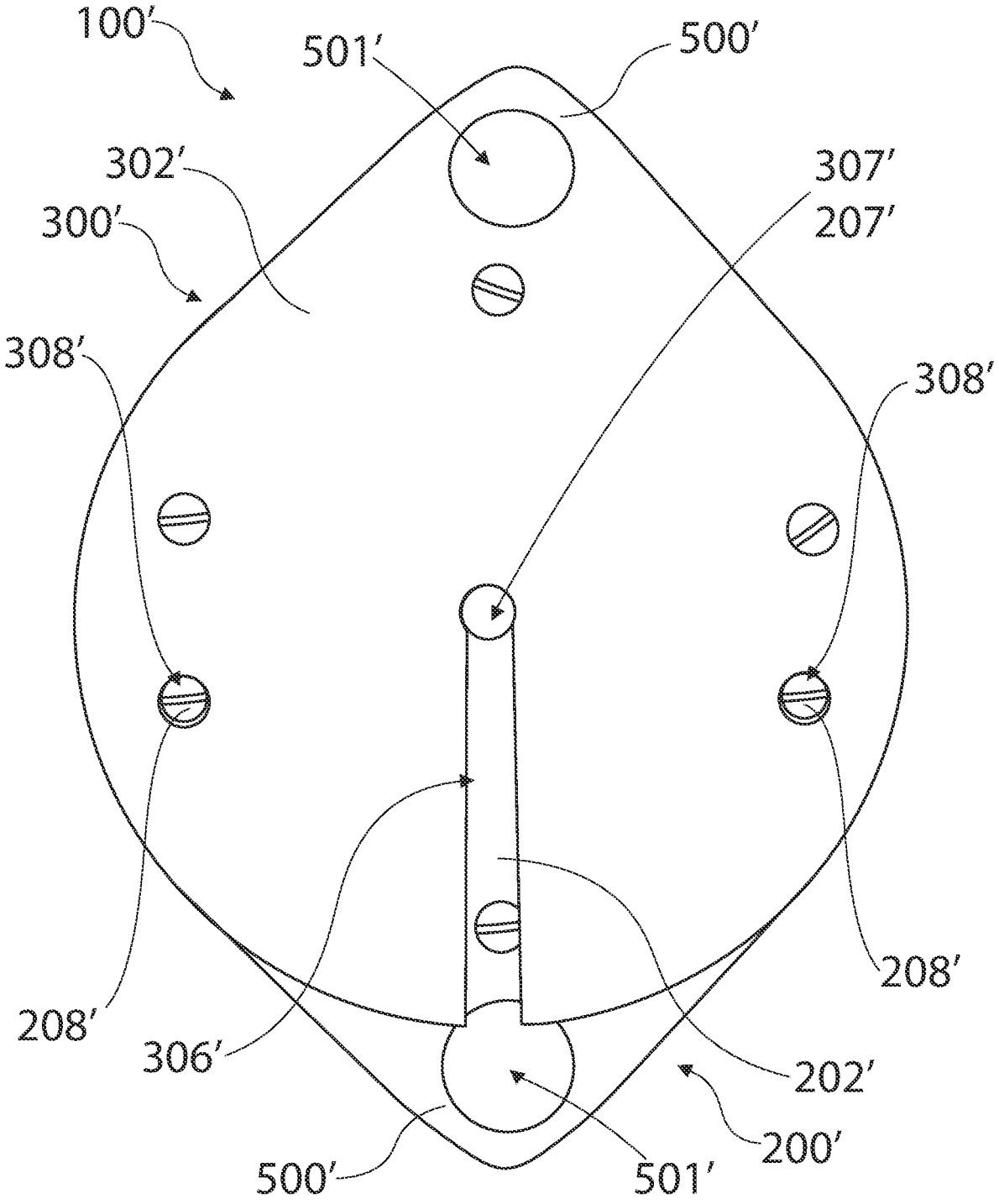
FIG. 10 is an alternative embodiment side view showing side walls of the spool cover.

FIG. 10 is an alternative embodiment side view showing one of the side walls 302' of the second cover portion 300' overlapping one of the side walls 202' of the first cover portion 200', forming the wire spool cover 100'. The embodiment 100' of FIG. 10 differs slightly from the embodiment 100 of FIGS. 2-9, since the handles 500' are smooth triangular contoured and the side walls 202', 302' overlap differently. These differences are permitted without departing from the scope of the invention as claimed. Further, the embodiment 100' of FIG. 10 differs slightly from the embodiment 100 of FIGS. 2-9 in that the embodiment 100 of FIG. 1 has a see-through outer wall 201 but the outer walls 201' of wire cover 100' are not necessarily see-through. As described, the side wall 302' of the second cover portion 300' has a circular body with a contoured triangular protruding portion forming the handle 500' with a finger hole 501'. The side wall 202' of the first cover portion 200' is designed similarly and has a circular body with a contoured triangular protruding portion forming the handle 500' with a finger hole 501'. Similar to FIG. 1, the slit 306' of the side wall 302' of the second cover portion 300' line up but do not overlap with the slit 206' (not shown) of the side wall 202' of the first cover portion 200'. The aperture 307' of the side wall 302' of the second cover portion 300' does overlap perfectly with the aperture 207' of the side wall 202' of the first cover portion 200' so a shaft 800 (not shown) can be force fitted. The heads of the screws 208' that serves as the ridges 208' on the side wall 202' of the first cover portion 200' is shown fitted through the holes 308', or depressions 308', of the side wall 302' of the second cover portion 300'. Besides the shape of the handles 500', the embodiment depicted in FIG. 10 function the same as that of FIGS. 1-9.

In an embodiment in accordance with this disclosure, the first cover portion 200 and the second cover portion 300 may be comprised of a plurality of cover portions adapted for enclosing a spool of wire 700 mounted on a shaft 800 without requiring clasps, hinges, pins, or other hardware to connect the plurality of cover portions to each other.

In an embodiment in accordance with this disclosure, only one of the first cover portion 200 and the second cover portion 300 may be adapted to attach to the shaft.

As an example of the method for installing the wire spool cover 100, the wire spool cover 100 is installed over the wire spool 700 already mounted on a shaft 800 by 1) encompassing a portion of the wire spool 700 with the first cover portion 200 and attaching the at least one side wall 202 of the first cover portion 200 to the shaft 800 adjacent one of the opposing side of the spool of wire 700; 2) encompassing an another portion of the wire spool 700 with the second cover portion 300 and attaching the at least one side wall 302 of the second cover portion 300 to the shaft 800 adjacent one of the opposing side of the spool of wire 700. If the spool cover 100 uses the slit 206, 306 and the aperture 207, 307 to attach to the shaft 800, the method can also have additional steps of sliding the shaft 800 through each of the slits 206, 306 and force-fitting the shaft 800 through the apertures 207, 307. If the spool cover 100 has an opening 305, there may be an additional step of threading an end of the wire 703 through the opening 305 on the outer wall 301 of the second cover portion 300. If the spool cover 100 has overlapping side walls 202, 302 with at least one depression 308 on the side wall 302 of the second cover portion 300 and at least one ridge 208 on the side wall 202 of the first cover portion 200, then there may be an additional step of overlapping and snapping in the at least one ridge 208 into the at least one depression 308 to combine the spool cover 100. If the wire spool cover 100 has a particularly shaped mating portion 204 on the at least one side wall 202 of the first cover portion 200 and a complementarily shaped mating portion 304 on the at least one side wall 302 of the second cover portion 300, then there may be an additional step of matingly interacting the particularly shaped mating portion 204 with the complementarily shaped mating portion 304 to combine the first cover portion 200 with the second cover portion 300 to form the spool cover 100.

It will be appreciated that this invention provides the installer of wire from a wire spool mounted on a shaft the ability to work quickly, pull the wire from the spool with vigorous force without creating tangles in the wire at the spool, reducing the need to interrupt the installation work to clear the tangles.

While preferred embodiments of the present invention have been shown and described, it will be apparent to those skilled in the art that many changes and modifications may be made without departing from the invention in its broader aspects. For example, it will be appreciated that one of ordinary skill in the art may mix and match the various components of the various embodiments of the invention without departing from the true spirit of the invention as claimed. The appended claims are therefore intended to cover all such changes and modifications as fall within the true spirit and scope of the invention.

What is claimed is:

1. A wire spool cover adapted for covering a spool of wire, wherein the spool has opposing sides and a central hollow tube forming the spool, the spool adapted to be mounted on a shaft with the shaft passing through the central hollow tube, the wire spool cover adapted for preventing tangling of the wire during use of the spool of wire on the shaft, comprising:

A first cover portion adapted to partially encompass a portion of the spool of wire, said first cover portion comprising an outer wall and at least one side wall; and A second cover portion adapted to partially encompass another portion of the spool of wire, said second cover portion comprising an outer wall and at least one side wall, wherein the at least one side wall of said first cover portion and the at least one side wall of said second cover portion are each adapted to attach to the shaft adjacent an opposing side of the spool of wire without removing the spool of wire from the shaft, and wherein the at least one side wall of said first cover portion and the at least one side wall of said second cover portion are each adapted to be attached to the shaft by means of a slit that is contiguous with an aperture in the center of the side wall that is of a diameter to accommodate the diameter of the shaft, wherein the slit is narrower than the diameter of the aperture where the slit connects with the aperture and gets wider in width as the slit approaches an outer edge of the side wall to allow the shaft to fit through the slit and force fit into the aperture to hold the spool cover in place on the shaft.

2. The wire spool cover of claim 1, wherein the at least one side wall of said first cover portion comprises a plurality of opposing side walls that are perpendicularly attached to the outer wall of said first cover portion and the at least one side wall of said second cover portion comprises a plurality of opposing side walls that are perpendicularly attached to the outer wall of said second cover portion.

3. The wire spool cover of claim 1, wherein said first cover portion and said second cover portion are positionable to each partially encompass the spool of wire so at least one edge of the outer wall of said first cover portion and at least one edge of the outer wall of said second cover portion align, and wherein the at least one side wall of said first cover portion comprises a particularly shaped mating portion that matingly fit with a complementarily shaped mating portion on the at least one side wall of said second cover portion such that said first cover portion and said second cover portion combine to form the spool cover around the spool of wire.

4. The wire spool cover of claim 1, wherein said second cover portion further comprises an opening on the outer wall adapted for allowing the wire on the spool to pass through the outer wall of said second cover portion, allowing the spool of wire to rotate freely on the shaft while encompassed by said spool cover to dispense the wire in a tangle-free manner from the spool as it passes through the opening.

5. The wire spool cover of claim 4, wherein the opening on the outer wall of said second cover portion is an elongated capsule shape.

6. The wire spool cover of claim 1, wherein the at least one side wall of said second cover portion at least partially overlaps with the at least one side wall of said first cover portion when combined to form the spool cover, and the at least one side wall of said second cover portion further comprises at least one depression and the at least one side wall of said first cover portion further comprises at least one ridge, wherein the at least one ridge of the at least one side wall of said first cover portion matingly fits into the at least one depression of the at least one side wall of said second cover portion when aligned and overlapped to keep said first cover portion and said second cover portion together as the spool cover.

7. The wire spool cover of claim 6, wherein the at least one depression of the at least one side wall of said second cover portion is two holes and the at least one ridge of the at least one side wall of said first cover portion is two bolt heads.

8. The wire spool cover of claim 3, wherein the particularly shaped mating portion of the at least one side wall of said first cover portion is at least one particularly shaped protrusion and the complementarily shaped mating portion of the at least one side wall of said second cover portion is at least one complementarily shaped indentation, wherein the at least one particularly shaped protrusion matingly fits into the at least one complementarily shaped indentation when said first cover portion and said second cover portion are aligned such that the first cover portion and the second cover portion combine to form the spool cover.

9. The wire spool cover of claim 8, wherein the at least one complementarily shaped indentation of the at least one side wall of said second cover portion is formed by a complementarily shaped layer of material attached between a portion of the outer wall of said second cover portion and a portion of the side wall of said second cover portion such that the at least one particularly shaped protrusion of the at least one side wall of said first cover portion matingly fits between the portion of the outer wall of said second cover portion and the portion of the side wall of said second cover portion, and an edge of the at least one particularly shaped protrusion of the at least one side wall of said first cover portion matingly aligns with the complementarily shaped layer of material when the at least one particularly shaped protrusion of the side wall of said first cover portion is pushed into the at least one complementarily shaped indentation of the at least one side wall of said second cover portion.

10. The wire spool cover of claim 1, wherein the at least one side wall of said first cover portion and the at least one side wall of said second cover portion are at least semi-circular in shape.

11. The wire spool cover of claim 1, wherein the outer wall of said first cover portion and the outer wall of said second cover portion are each half cylindrical in shape, so when aligned and combined, said first cover portion and said second cover portion form the spool cover with a cylindrical shape.

12. The wire spool cover of claim 1, wherein said first cover portion and said second cover portion comprise a plurality of cover portions adapted for enclosing the spool of wire mounted on the shaft without requiring clasps, hinges, pins, or other hardware to connect said plurality of cover portions to each other.

13. The wire spool cover of claim 1, wherein each of the at least one side wall of said first cover portion and each of the at least one side wall of said second cover portion further comprises at least one handle.

14. The wire spool cover of claim 13, wherein each of the at least one handle of the at least one side wall of said first cover portion and the at least one side wall of said second cover portion is comprised of an extended portion of the at least one side wall and further comprises at least one finger hole.

15. The wire spool cover of claim 1, wherein the outer wall of said second cover portion has a notch that can hold an end of a wire from the spool of wire when the spool of wire is not in use.

16. A wire spool cover adapted for covering a spool of wire, wherein the spool has opposing sides and a central hollow tube forming the spool, the spool adapted to be mounted on a shaft with the shaft passing through the central hollow tube, the wire spool cover adapted for preventing tangling of the wire during use of the spool of wire on the shaft, comprising:

A first cover portion adapted to partially encompass a portion of the spool of wire, said first cover portion comprising an outer wall and at least one side wall; and A second cover portion adapted to partially encompass another portion of the spool of wire, said second cover portion comprising an outer wall and at least one side wall, wherein the at least one side wall of said first cover portion and the at least one side wall of said second cover portion are each adapted to attach to the shaft adjacent an opposing side of the spool of wire without removing the spool of wire from the shaft, and wherein the at least one side wall of said first cover portion and the at least one side wall of said second cover portion are each adapted to be attached to the shaft by means of a slit that is contiguous with an aperture in the center of the side wall that is of a diameter to accommodate the diameter of the shaft, wherein the slit is narrower than the diameter of the aperture where the slit connects with the aperture.

* * * * *